US009729962B2

(12) United States Patent
Ishizaki

(10) Patent No.: US 9,729,962 B2
(45) **Date of Patent: *Aug. 8, 2017**

(54) STEREO MICROPHONE DEVICE

(75) Inventor: Hironao Ishizaki, Saitama-ken (JP)

(73) Assignee: TEAC Corporation, Tokyo (JP)

( * ) Notice: Subject to any disclaimer, the term of this patent is extended or adjusted under 35 U.S.C. 154(b) by 815 days.

This patent is subject to a terminal disclaimer.

(21) Appl. No.: 13/421,552

(22) Filed: Mar. 15, 2012

(65) Prior Publication Data

US 2013/0108059 A1 May 2, 2013

(30) Foreign Application Priority Data

Nov. 2, 2011 (JP) ..... 2011-241087

(51) Int. Cl.
*H04R 5/00* (2006.01)
*H04R 1/32* (2006.01)

(52) U.S. Cl.
CPC ..... *H04R 1/326* (2013.01)

(58) Field of Classification Search
CPC . H04R 1/08; H04R 1/083; H04R 1/16; H04R 1/18; H04R 1/406
USPC ..... 381/91, 112, 113, 114, 115, 122, 150, 381/170, 171, 361, 366, 367, 369, 92, 381/355, 362, 363, 365
See application file for complete search history.

(56) References Cited

U.S. PATENT DOCUMENTS 5,802,724 A * 9/1998 Rickard ..... A01D 34/90 30/276
6,307,591 B1 * 10/2001 Yoshida ..... H04N 5/2254 348/335
6,381,338 B1 4/2002 Ou
7,007,386 B1 3/2006 Stover
8,083,596 B1 12/2011 Silver et al.
(Continued)

FOREIGN PATENT DOCUMENTS

JP 51-143432 U 11/1976
JP 51-143433 U 11/1976
(Continued)

OTHER PUBLICATIONS

Extended European Search Report for corresponding EP Application No. 12159765.2, dated Jul. 23, 2012, 5 pages.
(Continued)

*Primary Examiner* — William A Jerez Lora
(74) *Attorney, Agent, or Firm* — Seed IP Law Group LLP

(57) ABSTRACT

There is provided an external stereo microphone device that makes it possible to change orientations of microphones over a wide range.

An external stereo microphone attached to a mobile electronic device includes a pair of symmetrically-positioned microphones 60, a holder unit 40 having a pair of holders 46 symmetrically positioned so as to accommodate the pair of microphones 60 respectively and a joint 48 for joining the pair of holders 46 together, and a case 14 having a substantially-cylindrical portion 20 that rotatably supports the holder unit 40 and a body 18 that accommodates a circuit board 22 of the case 14. The joint 48 is a substantially-plate-shaped region that joins outer circumferential edges of the holders 46 together and that has a circumferential width which is one-half or less of an entire circumference of the holder unit.

5 Claims, 6 Drawing Sheets

(56) References Cited

U.S. PATENT DOCUMENTS

| | | | | |
|---|---|---|---|---|
| 2005/0224332 | A1 | 10/2005 | Yamaguchi | |
| 2006/0177206 | A1 | 8/2006 | Takanashi | |
| 2007/0021836 | A1* | 1/2007 | Doty | A61F 2/44 623/17.13 |
| 2009/0185697 | A1* | 7/2009 | Matsui | H04R 1/326 381/122 |
| 2010/0008511 | A1 | 1/2010 | Kawano | |
| 2011/0311071 | A1 | 12/2011 | Gauger, Jr. et al. | |

FOREIGN PATENT DOCUMENTS

| | | | |
|---|---|---|---|
| JP | 55-14340 | U | 1/1980 |
| JP | 4072679 | B2 | 4/2008 |
| JP | 2009171355 | A | 7/2009 |
| JP | 2011086981 | A | 4/2011 |
| JP | 4753978 | B2 | 8/2011 |
| WO | 2004112426 | A1 | 12/2004 |

OTHER PUBLICATIONS

Extended European Search Report, dated Nov. 4, 2013, for corresponding European Application No. 12159768.6-1901, 8 pages.

Notice of Grounds for Rejection dated Apr. 21, 2015, for corresponding Japanese Patent Application Serial No. 2011-241087, 6 pages (including English language translation).

"Sets that have 'Technic Pneumatic Cylinder Bracket' (53178)," Peeron.com, Web. Jan. 2, 2009, <http://www.peeron.com/inv/parts/53178>, Retrieved from Internet Archive via Wayback Machine, <https://web.archive.org/web/20090102175958/http://www.peeron.com/inv/parts/53178>, 1 page.

* cited by examiner

ENLARGED D

STEREO MICROPHONE DEVICE

PRIORITY INFORMATION

This application claims priority to Japanese Patent Application No. 2011-241087, filed on Nov. 2, 2011, which is incorporated herein by reference in its entirety.

BACKGROUND OF THE INVENTION

Technical Field

The present invention relates to an external stereo microphone device attached to; for instance, a mobile electronic device a cellular phone.

Related Art

Multifunctional mobile electronic devices, like cellular phones, tablet terminals, and PDAs, have recently become widespread. There are cases where such a mobile electronic device is used in audio and video recoding applications. However, since many of the mobile electronic devices are not designed solely for audio (video) recording purposes, they are not equipped with microphones suitable for audio recording. Against the backdrop, several stereo microphone devices that can be attached to the mobile electronic devices as appropriate have hitherto been proposed.

However, inmost of the stereo microphone devices attached to the mobile electronic devices, microphones cannot be reoriented over a wide range and hence provide users with poor usability. A cellular phone, in particular, often has cameras on both front and rear sides thereof. When a moving image is recorded by use of the front camera of the cellular phone, it is desired that the microphone be oriented forwardly. In contrast to this, when a moving image is recorded by use of the rear camera, it is desirable that the microphone be oriented backward. Accordingly, the microphone is preferably reoriented through about 180 degrees. However, no external stereo microphone devices fulfilling these requirements have heretofore been available.

Some of the stereo microphone devices built in recorders enable appropriate reorientation of microphones. Recorders that enable reorientation of their microphones are disclosed in; for instance, JP 2009-171355 A and JP 4072679 B and JP 4753978 B. However, all of the devices described in connection with the microphones described in connection with JP 2009-171355 A and JP 4072679 B and JP 4753978 B are specifically designed for audio recording purpose. Since a usage pattern of the recorder (i.e., an orientation of the recorder assumed when it is used) is restricted to some extent, a movable range of the microphone becomes comparatively smaller. Specifically, techniques described in connection with JP 2009-171355 A and JP 4072679 B allow turning of a microphone only over a range of 90 degrees. Moreover, a technique described in connection with JP 4753978 B allows mere adjustment of an intersection angle between directional axes of two microphones over a range from 90 degrees to 120 degrees. Specifically, there have heretofore been available no stereo microphone devices that can change their orientations over a wide range.

Accordingly, the present invention is intended for providing an external stereo microphone device that makes it possible to change orientations of microphones over a wide range.

SUMMARY

A stereo microphone device of the present invention is an external stereo microphone device attached to a mobile electronic device, comprising:

a pair of symmetrically-positioned microphones;

a holder unit including a pair of holders symmetrically positioned in order to accommodate the pair of microphones respectively and a joint for joining the pair of holders together; and a substantially-cylindrical case that rotatably supports the holder unit, wherein the joint is a substantially-plate-shaped region that joins outer circumferential edges of the holders together and that has a circumferential width which is one-half or less of an entire circumference of the holder unit.

In a preferred mode, the stereo microphone device further includes a circuit board connected to the microphones by way of lead wires. A movable angle range of the holder unit is 180 degrees or more. The joint is situated opposite the circuit board with a long axis of the holder unit interposed therebetween when the holder unit is situated at a substantial center of the movable angle range. In another preferred mode, a small diameter portion whose outside diameter becomes smaller stepwise is provided at an inner end of each of the holders. An annular projection whose inside diameter is slightly larger than an outside diameter of the small diameter portion is provided on an inner circumferential surface of the cylindrical case so as to cover an outer circumference of the small diameter portion. In yet another preferred mode, the stereo microphone device further includes a revolving body that is provided in the joint and that revolves over an inner circumferential surface of the cylindrical case in association with rotation of the holder unit around a long axis of the holder unit.

According to the present invention, the joint is a substantially-plate-shaped region that joins the outer circumferential edges of the holders together and that has a circumferential width which is one-half or less of an entire circumference of the holder unit. Even when the orientation of the microphone is changed by rotating the holder unit over a wide angle, occurrence of interference of the joint with lead wires withdrawn from the microphones can effectively be prevented.

The invention will be more clearly comprehended by reference to the embodiments provided below. However, the scope of the invention is not limited to the embodiment.

BRIEF DESCRIPTION OF THE DRAWINGS

A preferred embodiment of the present invention will be described in detail by reference to the following drawings, wherein.

DETAILED DESCRIPTION

Figure 1:
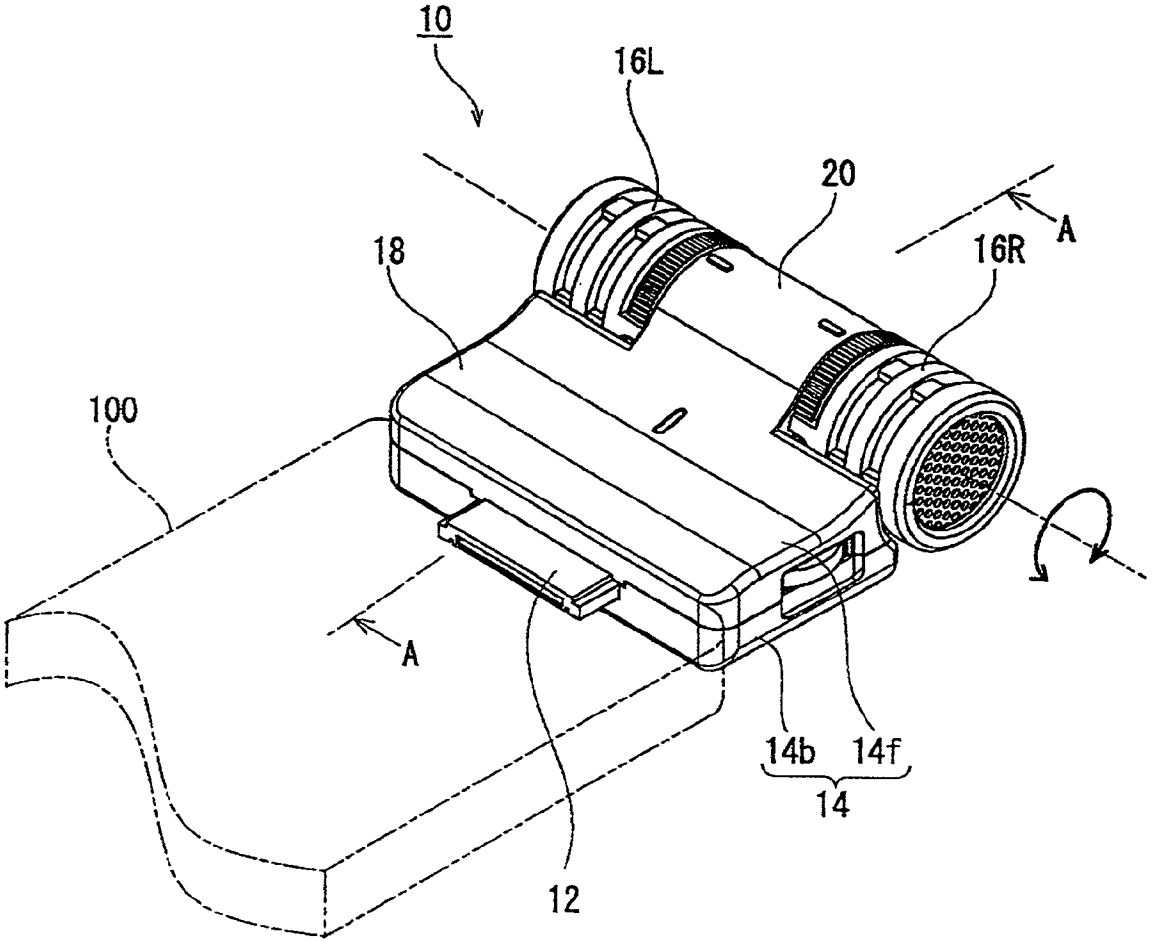
FIG. 1 is a perspective view of a stereo microphone device of an embodiment of the present invention.
Figure 2:
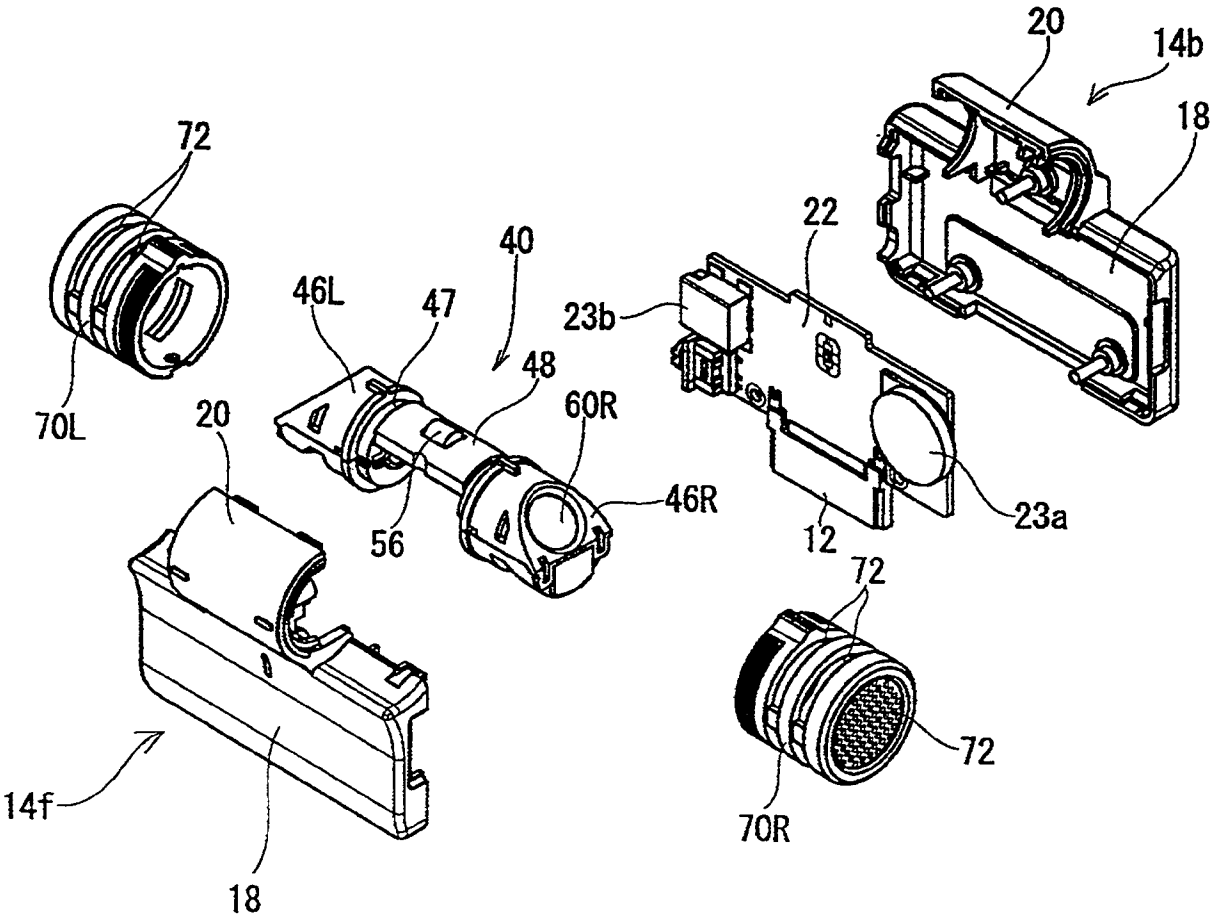
FIG. 2 is an exploded perspective view of the stereo microphone device.
Figure 3B:
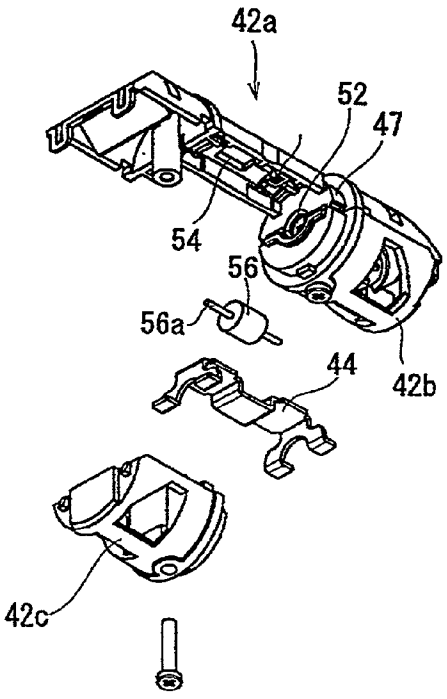
FIG. 3B is an exploded perspective view of the holder unit.
Figure 3A:
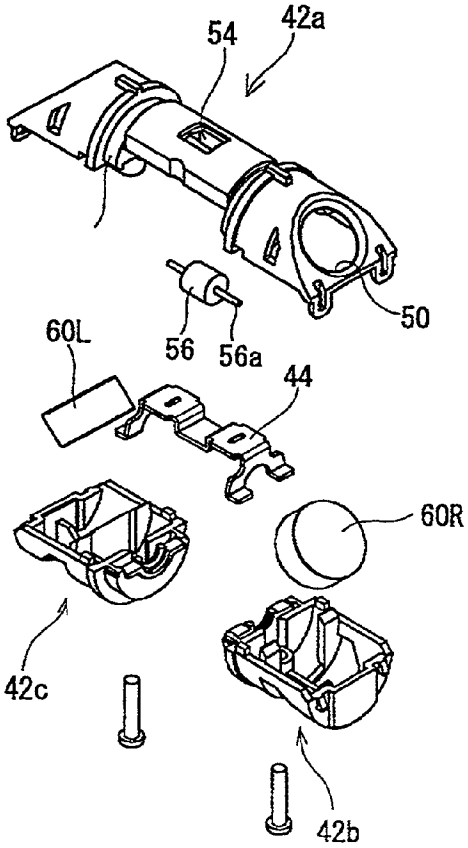
FIG. 3A is an exploded perspective view of a holder unit.
Figure 4:
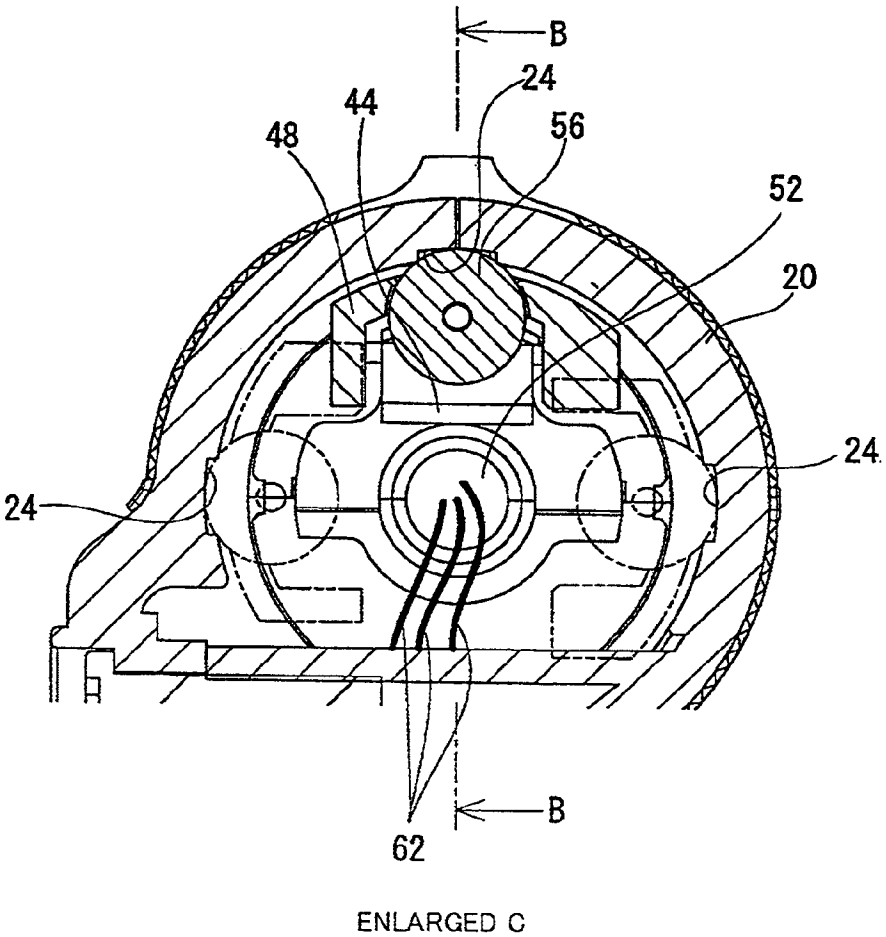
FIG. 4 is cross-sectional views taken along line A-A shown in FIG. 1.
Figure 4:
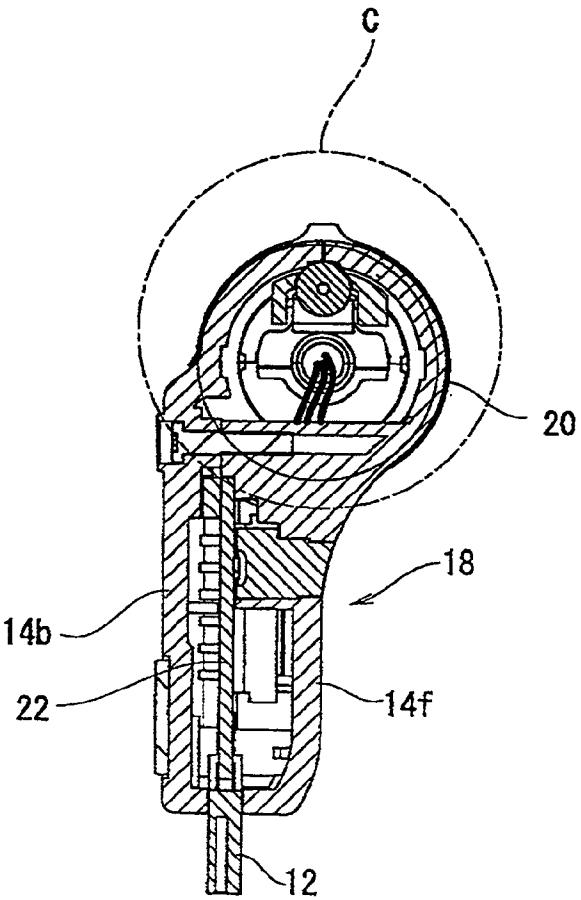
Figure 5:
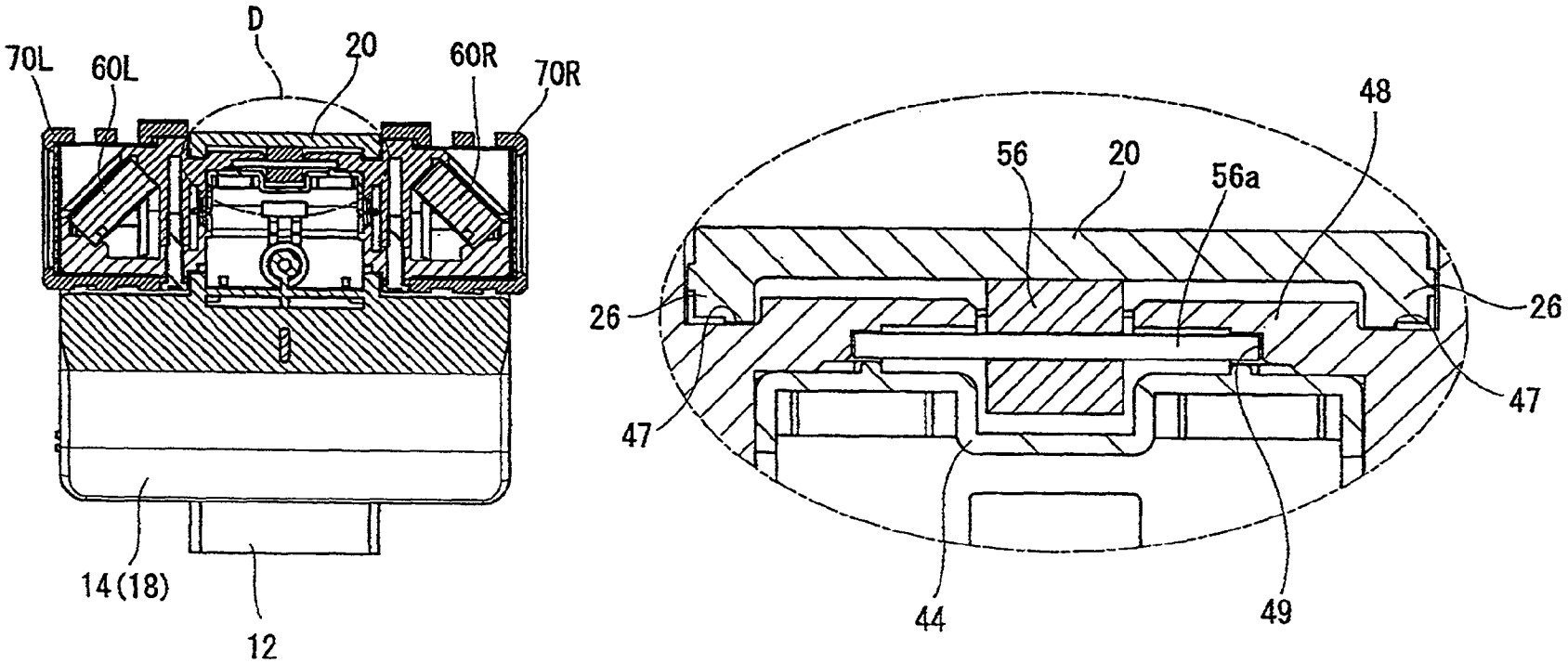
FIG. 5 is a cross-sectional view taken along line B-B shown in FIG. 4.

An embodiment of the present invention is hereunder described by reference to the drawings. FIG. 1 is a perspective view of a stereo microphone device 10 of the embodiment of the present invention. FIG. 2 is an exploded perspective view of the stereo microphone device. FIGS. 3A and 3B are exploded perspective views of a holder unit 40. FIG. 3A is a perspective view of the holder unit taken from above, and FIG. 3B is a perspective view of the same taken from below. FIG. 4 is cross-sectional views taken along line A-A shown in FIG. 1. FIG. 5 is a cross-sectional view taken along line B-B shown in FIG. 4.

The stereo microphone device 10 is an external microphone attached as appropriate to a mobile electronic device; for instance, a cellular phone, a tablet terminal, and a PDA. FIG. 1 illustrates the microphone attached to a cellular phone, in particular, a smartphone 100 that is a multifunctional cellular phone equipped with functions similar to those of a PC.

The stereo microphone device 10 assumes a substantially-rectangular shape, as a whole. A connection terminal 12 is formed so as to protrude from one end of the stereo microphone device 10, thereby enabling establishment of electrical connections with various electronic devices. Two microphone units 16R and 16L (subscripts R and L are omitted when there is no necessity to make a distinction between the left and the right, and the same also holds true of other members in the following descriptions); namely, a left microphone unit 16L and a right microphone unit 16R are symmetrically arranged at the other end of the stereo microphone device 10 along a single axis. Each of the two microphone units 16 are rotatable through 180 degrees around a long axis, to thus make it possible to change an orientation of a microphone over a wide range. The reason why a movable angle of the microphone units 16 is set to 180 degrees is that the microphone units can be made compatible with various electronic devices.

Specifically, in the case of the stereo microphone device 10 connected to various electronic devices, such as a cellular phone and a tablet terminal, a desirable orientation for the microphone units 16 varies according to a kind of an electronic device connected. For instance, when the stereo microphone device 10 is connected to an electronic device whose camera intended for recording a moving image is provided on its front side, it is desirable that the microphone units 16 be oriented in the same forward direction as is the camera. Conversely, when the stereo microphone device 10 is connected to an electronic device whose camera intended for recording a moving image is provided on its rear side, it is desirable that the microphone unit 16 be oriented in the same backward direction as is the camera. In short, the desirable orientation for the microphone units 16 greatly varies according to the electronic device connected. Further, in many electronic devices, a camera for recording a moving image is provided on both front and rear sides of the device. In order to enable either of the cameras of such an electronic device to preferably record sounds during image recording, the microphone units 16 are expected to rotate through at least 120 degrees or more and preferably 180 degrees or more. Therefore, in the present embodiment, the movable angle of the microphone units 16 is set to 180 degrees. A configuration of the stereo microphone device 10 is hereunder described in detail.

As shown in FIG. 2, the stereo microphone device 10 is provided with a dual-split case 14 made up of a front case 14*f* and a rear case 14*b*. The case 14 is roughly divided into a body 18 and a cylindrical portion 20.

The body 18 assumes a substantially-rectangular shape, and a circuit board 22 is housed in the body 18. In addition to including an AD converter circuit for converting a (analogue) voltage signal into a digital signal and an equalizer circuit for controlling sound quality of an audio signal input by way of the microphone units 16, the circuit board 22 has user interface components, such as a volume control 23*a*, an USB terminal port 23*b*, and the connection terminal 12. These user interface components are exposed outside by way of an opening 15 formed in a side surface of the case 14.

The cylindrical portion 20 is a region that rotatably supports the holder unit 40 and that is made by combination of a semicircular portion formed on the front case 14*f* with another semicircular portion formed on the rear case 14*b*. As is obvious from FIG. 4, three stopper grooves 24 extending along the longitudinal direction of the cylindrical portion 20 (i.e., a direction perpendicular to the drawing sheet of FIG. 4) are provided along an inner circumferential surface of the cylindrical portion 20 while circumferentially spaced apart from each other at an angle of 90 degrees. As is obvious from FIG. 5, an inwardly-projecting annular projection 26 is provided at both axial ends of the cylindrical portion 20.

As is obvious from FIG. 4, in the present embodiment, the cylindrical portion 20 is placed while offset from the body 18 along a thicknesswise direction (a horizontal direction in FIG. 4) in such a way that the center of the cylindrical portion 20 is placed slightly upwards as compared with the center of the body 18 (i.e., in a rightward direction in FIG. 4). The reason for such a positional relationship is that a depthwise length (in a vertical direction of FIG. 4) of the stereo microphone device 10 is shortened to thereby enhance stability when the stereo microphone device 10 is placed on a flat surface.

The holder unit 40 that is rotatably supported by the cylindrical portion 20 is a retainer member for retaining two microphones 60. As shown in FIGS. 3A and 3B, the holder unit 40 is an assembly part made up of a plurality of components, like an upper holder piece 42*a*, a right lower holder piece 42*b*, a left lower holder piece 42*c*, and presser hardware 44. The assembled holder unit 40 is roughly classified into two holders 46 for accommodating the respective microphones 60 and a joint 48 for joining the two holders 46 together. The holders 46 are substantially-cylindrical regions that accommodate the respective microphones 60, and upper surfaces of the respective holders 46 are tapered so as to become lower toward the outside. A sound collection opening 50 for letting ambient sounds reach the microphone 60 is formed in each of the tapered surfaces.

The microphone 60 that transduces sounds into a voltage signal is held in each of the holders 46 while inclined at an angle of about 45 degrees with respect to the long axis; namely, in such a way that a sound collection plane of the microphone 60 becomes substantially parallel to the tapered surface (see FIG. 5). Lead wires 62 are drawn from each of the microphones 60 and electrically connected to an electric circuit on the circuit board 22. A lead wire hole 52 for letting the lead wires 62 pass is formed in a substantial center of an inner end face of each of the holders 46.

Each of the holders 46 is covered with a microphone cap 70. Sound collection holes 72 for letting ambient sounds reach the microphone 60 are formed in a circumferential surface and a side surface of each of the microphone caps 70. Each of the microphone units 16 is formed by covering the holder 46 with the microphone cap 70.

A small diameter portion 47 whose outside diameter becomes smaller stepwise is formed at an inner end portion of each of the holder 46. Since the outside diameter of the small diameter portion 47 is smaller than an outside diameter of the joint 48 to be described later, the small diameter portion 47 forms a trench between the joint 48 and the holder 46. A width of the small diameter portion 47 is larger than a width of the annular projection 26 provided in the cylindrical portion 20 of the case 14, and the outside diameter of the small diameter portion 47 is slightly smaller than an inside diameter of the annular projection 26. When the stereo microphone device 10 is assembled, a periphery of the small diameter portion 47 is surrounded by the annular projection 26. As a result of the periphery of the cylindrical portion being surrounded by the annular projection 26, the holder unit 40 is allowed to rotate only around the long axis, and other movements of the holder unit 40 are regulated.

Contacts (not shown) are provided on the holder unit 40, and counter contacts (not shown) that collide against the corresponding contacts when the holder unit 40 are rotated through a given angle are provided on the case 14. A rotation angle of the holder unit 40 is regulated by means of the contacts and the counter contacts. In the embodiment, the contacts and the counter contacts are provided in such a way that the movable angle of the holder unit 40 comes to about 180 degrees.

The two holders 46 are joined together by means of the joint 48 so as to synchronously rotate. The joint 48 is a plate-like region that is provided on an outer circumferential position with reference to the lead wire hole 52 and that connects neighborhoods of circumferential edges of the two holders 46. In more detail, the joint 48 assumes a substantially-U-shaped form that is made by inwardly bending both substantially-circular-arc ends of the joint 48 at an angle of about 90 degrees. An outside diameter of the joint 48 is smaller than an inside diameter of the cylindrical portion 20 of the case 14, and a gap having a distance H is formed between the joint 48 and the cylindrical portion 20.

An outer circumferential surface of the joint 48 assumes a circular-arc shape. In the embodiment, a center angle of the circular arc is about 75 degrees. Put it another way, a circumferential width of the joint 48 accounts for about one-fifth of the entire circumference of the holder unit 40. A movable range of the holder unit 40 is 180 degrees. In a state in which the holder unit 40 is placed at a center of the movable range, the joint 48 is situated opposite the circuit board 22 with the long axis of the holder unit 40 interposed therebetween. The joint 48 is given such a configuration because of the following reasons.

Figure 6:
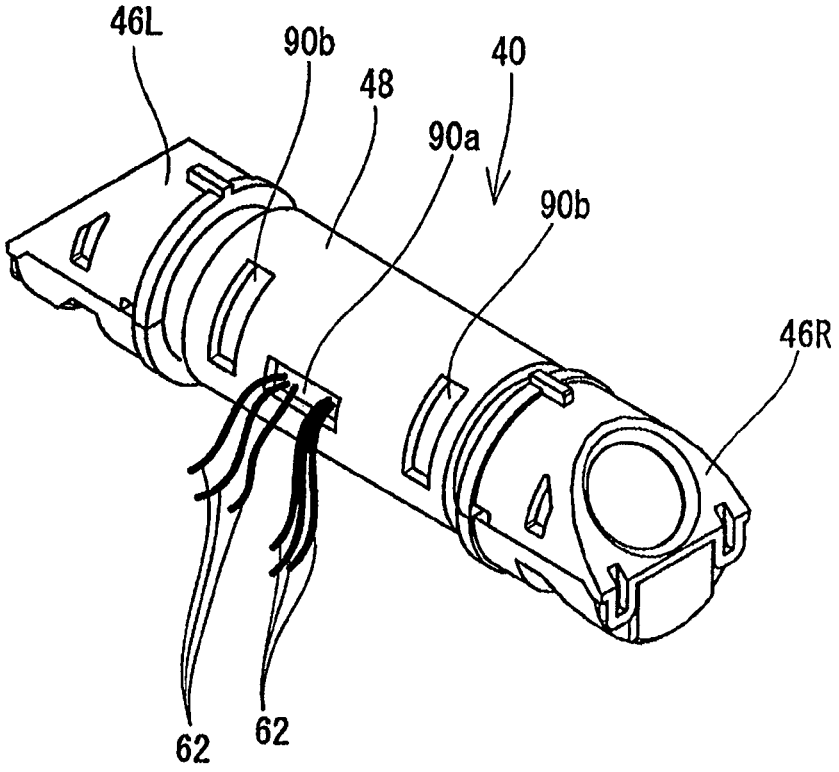
FIG. 6 is a perspective view of a holder unit of a related-art microphone.

In a related-art microphone; for instance, a microphone described in JP 2009-171355 A, the joint 48 joining the two holders 46 together (expressed as "shaft 25*a*" in JP 2009-171355 A) assumes a perfect cylindrical shape as shown in FIG. 6. In such a related-art microphone, an axially-extended slit 90*a* and a circumferentially-extended slit 90*b* are formed in a side surface of the cylindrical joint 48. The lead wires 62 from the microphones 60 accommodated in the holders 46 are withdrawn outside by way of the slits 90. When a movable angle of the microphone unit 16 is narrow as in the case of the microphone described in JP 2009-171355 A, withdrawing the lead wires 62 by utilization of the slits 90*a* and 90*b* poses no substantial problem. On the contrary, in a case where the movable angle of the microphone unit 16 is large (180 degrees) as described in connection with the present embodiment, the lead wires 62 interfere with edges of the respective slits 90 as the holders 46 rotate, which sometimes inflicts damage on the lead wires 62.

In the present embodiment, in order to lessen the problem, the circumferential width of the joint 48 is sufficiently made smaller than the entire circumference of the holder unit 40. Further, the joint 48 is situated opposite the circuit board 22 while the holder unit 40 is situated at the center of the movable range; namely, a direction opposite to the direction of extension of the lead wires 62. As indicated by a two-dot chain line in FIG. 4, even when the holder unit 40 (the joint 48) is rotated through 180 degrees, such a configuration prevents the joint 48 from interfering with the lead wires 62, so that damage on the lead wires 62 can effectively be prevented.

In the present embodiment, the circumferential width of the joint 48 is set to about one-fifth of the entire circumference of the holder unit 40. However, the circumferential width can be changed as appropriate in accordance with the rotating range of the microphone units 16, so long as the circumferential width is one-half or less of the entire circumference of the holder unit 40 (the center angle of the circular arc of the outer circumferential surface is 180 degrees or less). The circumferential width that is a quarter or less of the entire circumference of the holder unit 40 (the center angle of the circular arc of the outer circumferential surface is 90 degrees or less) is more desirable.

A substantially-rectangular through hole 54 is formed at a substantial center of the joint 48. A roller 56 projects outside by way of the through hole 54. The roller 56 is a revolving body that revolves along an interior surface of the cylindrical portion 20 in conjunction with rotation of the holder unit 40 around the long axis. The roller 56 is made of an elastic material, like rubber and a soft resin. A groove 49 for housing a rotation axis 56*a* of the roller 56 is formed on an interior surface of the joint 48. The groove 49 is covered with presser hardware 44 while the rotation axis is accommodated in the groove 49, whereby the roller 56 is rotatably held. The rotation axis 56*a* may be a shaft made of a resin or metal or an axis having a spring characteristic.

An outside diameter of the roller 56 is larger than at least a width of the stopper groove 24 formed in the cylindrical portion 20. An extent to which the roller 56 projects from an exterior surface of the joint 48 is slightly larger than the gap H between the inside diameter of the cylindrical portion 20 and an outside diameter of the joint 48. The reason for the setting the dimensions is as follows.

If the roller 56 is absent, the holder unit 40 can be rotated at very small operational load (force required to rotate the holder unit 40) without undergoing substantial resistance. When the operational load is small such as that mentioned above, operation is easy. In the meantime, actual feeling of operation is less likely to arise, and the user feel uneasy or insufficient. Moreover, in a state where the roller 56 is absent, operational load becomes substantially constant at any angle, which makes the user difficult to grasp an amount of operation (an amount of rotation). Moreover, since the operational load is small at any angle, there also arises a problem of the holder unit 40 (the microphone units 16) being not held stationary at a desired angle. Further, the holder unit 40 (the microphone units 16) vibrates, which deteriorates sound quality of an audio signal to be recorded.

In the present embodiment, the roller 56 is placed so as to lessen the problems. As previously mentioned, the extent to which the roller 56 of the present embodiment projects from the exterior surface of the joint 48 is slightly larger than the amount of gap between the inside diameter of the cylindrical portion 20 and the outside diameter of the joint 48. Therefore, when the stereo microphone device 10 is assembled, the roller 56 experiences nominal pressure from the interior surface of the cylindrical portion 20. The pressure induces appropriate operational load, to thus provide the user with suitable feeling of operation. Moreover, vibrations of the holder unit 40 (the microphone units 16) are dampened by the pressure developing between the roller 56 and the cylindrical portion 20, so that sound quality of an audio signal to be recorded can be enhanced.

Further, when the roller 56 is experiencing pressure from the interior surface of the cylindrical portion 20, a neighborhood of the contact between the roller 56 and the cylindrical portion 20 becomes slightly flattened elastically. However, when the roller 56 reaches the stopper groove 24, the roller 56 elastically restores to its original circular shape as shown in FIG. 4, whereupon the top of the roller 56 enters the stopper groove 24. The roller 56 entered the stopper groove 24 requires comparatively large force to climb over the stopper groove 24, thereby causing an upsurge of operational load (the force required to cause additional rotation). The temporal upsurge of operational load transmits to the user as appropriate click. By means of the click, the user can easily recognize that a given amount of rotation is made. Since the roller 56 does not climb over the stopper groove 24 unless comparatively large force is given to the roller 56, the holder unit 40 (the microphone units 16) can be stopped stationary at an angle corresponding to the stopper grooves 24.

Specifically, the stopper grooves 24 are formed along the inner circumferential surface of the cylindrical portion 20, and the holder unit 40 is provided with the roller 56 that revolves while pressed against the inner circumferential surface of the cylindrical portion 20. Ease of rotating operation of the holder unit 40 (the microphone units 16) can thereby be enhanced.

In the embodiment, the three stopper grooves 24 are provided at an interval of 90 degrees. However, the number of the stopper grooves 24 and the intervals at which the stopper grooves 24 are provided can also be changed as appropriate. In some cases, the stopper grooves 24 can also be omitted. The stopper grooves 24 is not limited to a linear groove but also assume a spherical groove, so long as the top of the roller can fit into the groove. In the embodiment, the cylindrical roller 56 is used as a revolving body. However, a spherical body instead of the roller 56 can also be employed, so long as the spherical body can revolve over the inner circumferential surface of the cylindrical portion 20. In any event, so long as the revolving body that revolves while pressed against the inner circumferential surface of the cylindrical portion 20 is provided as described in connection with the embodiment, the ease of rotating operation of the holder unit 40 (the microphone units 16) can be enhanced.

Any of the foregoing configurations is merely illustrative. The other configurations can also be changed appropriately, so long as at least the joint 48 is a substantially-plate-shaped region that joins outer peripheral edges of the respective holders 46 together and that assumes a circumferential width that is one-half or less of the entire circumference of the holder unit 40.

What is claimed is:

1. An external stereo microphone device attached to a mobile electronic device, comprising:

a pair of symmetrically-positioned microphones;

a holder unit including a pair of holders symmetrically positioned in order to accommodate the pair of microphones respectively and a joint for joining the pair of holders together, the holders forming outer circumferential edges;

a case having a cylindrical portion that rotatably supports the holder unit and a revolving body rotatably coupled to the joint, the revolving body receiving pressure from the inner circumferential surface of the case, wherein the joint is a substantially-plate-shaped region that joins the outer circumferential edges of the holders together and that has an outer circumferential surface assuming a circular-arc shape, a center angle of the circular arc shape being 180 degrees or less, and a circumferential width which is one-half or less of an entire circumference of the holder unit.

2. The stereo microphone device according to claim 1, further comprising:

a circuit board connected to the microphones by way of lead wires, wherein a movable angle range of the holder unit is 180 degrees or more; and the joint is situated opposite the circuit board with a long axis of the holder unit interposed therebetween when the holder unit is situated at a substantial center of the movable angle range.

3. The stereo microphone device according to claim 1, wherein a small diameter portion whose outside diameter becomes smaller stepwise is provided at an inner end of each of the holders, and an annular projection whose inside diameter is slightly larger than an outside diameter of the small diameter portion is provided on an inner circumferential surface of the case so as to cover an outer circumference of the small diameter portion.

4. The stereo microphone device according to claim 1, wherein the revolving body is provided in the joint and revolves over the inner circumferential surface of the cylindrical portion of the case in association with rotation of the holder unit around a long axis of the holder unit.

5. The stereo microphone device according to claim 4, further comprising:

a shaft coupled to the joint;

a groove formed on an interior surface of the joint; and a cover, the shaft being disposed within the groove between the cover and the interior surface of the joint.

* * * * *